US007209154B2

(12) United States Patent
Matsuzoe

(10) Patent No.: US 7,209,154 B2
(45) Date of Patent: Apr. 24, 2007

(54) METHOD FOR CONTROLLING ION GENERATION, ION GENERATOR, AND IMAGE FORMING APPARATUS EQUIPPED THEREWITH

(75) Inventor: Hisanobu Matsuzoe, Fukuoka (JP)

(73) Assignee: Fukuoka Technoken Kogyo, Co., Ltd., Fukuoka-shi (JP)

( * ) Notice: Subject to any disclaimer, the term of this patent is extended or adjusted under 35 U.S.C. 154(b) by 155 days.

(21) Appl. No.: 10/992,601

(22) Filed: Nov. 19, 2004

(65) Prior Publication Data

US 2006/0109332 A1 May 25, 2006

(51) Int. Cl.

| | |
|---|---|
| ***B41J 2/41*** | (2006.01) |
| ***B41J 2/415*** | (2006.01) |
| ***G03G 15/05*** | (2006.01) |
| ***H01T 19/00*** | (2006.01) |

(52) U.S. Cl. ..... 347/123

(58) Field of Classification Search ..... 347/112, 347/123

See application file for complete search history.

(56) References Cited

U.S. PATENT DOCUMENTS 6,646,663 B2 * 11/2003 Kamoshida et al. ..... 347/112

FOREIGN PATENT DOCUMENTS

| | | |
|---|---|---|
| JP | 8-72292 A | 3/1996 |
| JP | 2000-85175 A | 3/2000 |

OTHER PUBLICATIONS

Translation of JP 2000-085175.*
Translation of JP 08-072292.*

* cited by examiner

*Primary Examiner*—Huan Tran
(74) *Attorney, Agent, or Firm*—Oblon, Spivak, McClelland, Maier & Neustadt, P.C.

(57) ABSTRACT

To provide an ion generator and an image forming apparatus which control selective ion generation by a voltage lower than the conventional voltage, and are inexpensive and sized as small as possible. In an ion generator which selectively generates ions, ion generation is controlled by temperature control of discharge electrode parts, whereby an ion generator that is inexpensive and sized as small as possible is provided in which discharge electrodes and an electrode are disposed via dielectrics disposed between these, heating elements are provided corresponding to the discharge electrodes, the temperatures of the discharge electrodes are controlled, and an appropriate high voltage is applied between the discharge electrodes and the an electrode, the discharge of the discharge electrodes is controlled by heating of the heating elements, and generation of ions by discharge of the discharge electrodes can be controlled by a low voltage in response to heating control of the heating elements.

5 Claims, 3 Drawing Sheets

A—A section

○ : Discharged × : Not discharged

| Heating \ AC | 1.0kVp-p | 1.5kVp-p | 2.0kVp-p | 2.5kVp-p | 3.0kVp-p | 3.5kVp-p |
|---|---|---|---|---|---|---|
| Not heated | × | × | × | × | ○ | ○ |
| Heated | × | × | ○ | ○ | ○ | ○ |

METHOD FOR CONTROLLING ION GENERATION, ION GENERATOR, AND IMAGE FORMING APPARATUS EQUIPPED THEREWITH

BACKGROUND OF THE INVENTION

1. Field of the Invention

The present invention relates to a completely novel ion generator and image forming apparatus which are used for a rewritable paper and a writing device such as an electrostatic recording device, etc.

2. Prior Art

Among various recording devices, electrophotographic recording devices employ a non-impact recording method and have features in that the noise level is low, characters can be recorded clearly, the recording rate is high, and the running cost is comparatively low. Therefore, recently, they have been used as output terminal devices of OA equipment, and their market also has been rapidly expanding.

An outline of the electrophotographic recording devices is described by showing the construction of the recording part of a laser beam printer as one of the electrophotographic recoding devices in FIG. 6. In an electrophotographic recording device, first, as shown in FIG. 6, in normal cases, a photoconductor drum 100 is used. The entire surface of the photoconductor drum 100 is uniformly charged to, for example, approx. −800 V by negative charge by a charging device 101 consisting of a corona charger. Then, the photoconductor drum 100 is irradiated with a laser beam 102 in response to an image signal. The photoconductor drum 100 lowers in resistance only at a portion irradiated with a beam, so that the negative charge on the portion irradiated with the laser beam 102 is erased to form an electrostatic latent image. Normally, as the laser, one semiconductor laser is used, and a beam modulated according to the image is scanned by a rotating polygon mirror (not shown). The electrostatic latent image thus formed is developed by a developing device 103. Namely, to the portion of the electrostatic latent image on the photoconductor drum 100 where the negative charge has been erased, toner of coloring fine particles negatively charged by reversal development adheres by being applied with a bias of approximately −300 V, whereby the electrostatic latent image is visualized.

A recording sheet 105 taken out of a paper cassette that is not shown by paper feed rollers 104 is conveyed in timing with the image signal and comes into contact with the photoconductor drum 100. At this point, the visualized toner image is transferred onto the recording sheet 105. On a transfer charger 106, a positive charge is supplied from, for example, the back side of the recording sheet 105, whereby the image developed by the negatively charged toner on the photoconductor drum 100 is attracted onto the recording sheet 105 and transferred thereon. The recording sheet 105 on which the image has been transferred is separated from the photoconductor drum 100 by a separating charger 107. Last, the toner is fixed onto the recording sheet 105 by being heated and pressurized by a fixing device 111 consisting of heat rollers 110, etc., and then recording is ended.

On the photoconductor drum 100, remaining toner that has not been transferred onto the recording sheet 105 still remains. After the photoconductor drum 100 is cleaned by scraping-off such remaining toner by a cleaner 108, the surface of the photoconductor drum 100 is entirely exposed by an erasing lamp 109 consisting of an LED, etc., to erase the charge.

Thus, the electrophotographic recording device forms an image through the steps of charging, latent image forming, developing, transferring, and fixing. Last, the photoconductor drum 100 is completely cleaned through the cleaning step and becomes reusable. Each step may slightly differ depending on the device type, however, the steps as described above are basically employed.

In these electrophotographic recording devices, as described above, in order to form an electrostatic latent image, a photoconductor drum 100 made of an organic material or an inorganic material as an optical semiconductor is necessary. Such a photoconductor drum 100 is an optical semiconductor, and is formed from a functional material having a resistance that changes when irradiated with a beam, weakness against heat, and easily lowers in sensitivity due to a long period of irradiation of a beam, and has a short life, and is high in cost due to its complicated construction. Furthermore, in order to form an electrostatic latent image by irradiating the photoconductor drum 100 with a laser beam 102, a laser unit having a rotating polygon mirror (not shown) is necessary. This laser unit requires rotation of a rotating polygon mirror with accuracy at a constant high speed, and is very expensive and large in size.

The present invention has been made in view of the above-mentioned circumstances, and an object thereof is to provide a method for controlling ion generation, which is controllable by a low voltage, an ion generator and an image forming apparatus equipped therewith, which are sized as small as possible and can form an electrostatic latent image at low cost.

SUMMARY OF THE INVENTION

The invention provides a method for controlling ion generation, which controls ion generation by controlling the temperature of discharge electrodes, and is featured in that presence or absence of discharge is controlled by varying the discharge starting voltage by heating of respective discharge electrodes to which voltage that does not generate discharge only by application thereof but generates discharge by heating is applied. Thereby, it is not necessary to control a high voltage applied to respective discharge electrodes for each of the discharge electrodes and it becomes possible to control ion generation by a low voltage by controlling the temperature of the respective discharge electrodes.

The invention is featured in that an ion generator for selectively generating ions includes discharge electrodes and heating elements disposed according to the respective discharge electrodes, wherein voltage is applied, which does not generate discharge only by being applied to the discharge electrodes but generates discharge by heating the discharge electrodes, and generation of ions generated by discharge of the discharge electrodes is controlled by heating the heating element.

By employing this construction, the ion generator of the invention, it becomes possible to control ion generation, which is generated by discharge of the discharge electrodes, by controlling the heating of heating elements by a low voltage without necessity of controlling a high voltage to be applied to each discharge electrode by a discharge electrode bias, so that an ion generator that is inexpensive and sized as small as possible is obtained.

Furthermore, in an ion generator for selectively generating ions, a discharge electrode and an electrode are disposed by with a dielectric placed therebetween, a voltage which does not generate discharge only by application thereof but generating discharge by heating is applied between the discharge electrodes and the electrode, and generation of ions generated by discharge of the discharge electrodes is controlled by heating the heating element disposed according to the respective discharge electrodes. Therefore, an ion generator is obtained which is inexpensive and sized as small as possible and is able to control generation of ions generated discharge of the discharge electrodes at a low voltage through heating control of the heating elements.

Furthermore, an image forming apparatus is obtained which is inexpensive and sized as small as possible and constructed so as to selectively irradiate a recording medium rewritable by electrical fields with ions to form an electrostatic latent image on the surface of the recording medium by using an ion generator wherein discharge electrodes and an electrode are disposed via dielectrics disposed between these, a voltage which does not generate discharge only by application thereof but generating discharge by heating is applied between said discharge electrodes and the electrode, discharge of said discharge electrodes is controlled by heating the heating element disposed according to the respective discharge electrodes, and generation of ions generated by discharge of the discharge electrodes is controlled by heating the heating elements disposed according to the respective discharge electrodes, and generation of ions generated by discharge of the discharge electrodes can be controlled by a low voltage in response to heating control of the heating elements, and selectively displays the image.

Furthermore, an ion forming apparatus is obtained which is inexpensive and sized as small as possible and constructed so as to selectively irradiate a recording medium rewritable by electrical fields with ions to form an electrostatic latent image on the surface of the recording medium by using an ion generator wherein discharge electrodes and an electrode are disposed via dielectrics disposed between these, a voltage which does not generate discharge only by application thereof but generating discharge by heating is applied between said discharge electrodes and the electrode, discharge of said discharge electrodes is controlled by heating the heating element disposed according to the respective discharge electrodes, and generation of ions by discharge of the discharge electrodes can be controlled by a low voltage in response to heating control of the heating elements, and visualizes the electrostatic latent image by toner or ink, forms a visible image of toner or ink on the image carrier surface, transfers and forms the visible image onto a recording sheet.

According to the invention, a method for controlling ion generation controls ion generation by controlling the temperature of discharge electrodes, wherein presence or absence of discharge is controlled by varying the discharge starting voltage by heating of respective discharge electrodes to which voltage that does not generate discharge only by application thereof but generates discharge by heating is applied. Therefore, it becomes possible to provide a method for controlling ion generation by a low voltage without necessity of controlling a high voltage to be applied to each discharge electrode by a discharge electrode bias.

Further, an ion generator for selectively generating ions includes discharge electrodes and heating elements disposed according to the respective discharge electrodes, wherein a voltage is applied, which does not generate discharge only by being applied to the discharge electrodes but generates discharge by heating the discharge electrodes, and generation of ions generated by discharge of the discharge electrodes is controlled by heating the heating element. Therefore, it becomes possible to provide a method for controlling ion generation by a low voltage without necessity of controlling a high voltage to be applied to each discharge electrode by a discharge electrode bias, so that an ion generator that is inexpensive and sized as small as possible is obtained.

Still further, in an ion generator for selectively generating ions, a discharge electrode and an electrode are disposed with a dielectric placed therebetween, a voltage which does not generate discharge only by application thereof but generating discharge by heating is applied between the discharge electrodes and the electrode, and generation of ions generated by discharge of said discharge electrodes is controlled by heating of said heating element disposed according to said respective discharge electrodes. Therefore, it becomes possible to control ion generation, which is generated by discharge of the discharge electrodes by controlling the heating of the heating elements by a low voltage, so that an ion generator that is inexpensive and sized as small as possible can be obtained.

Further, since a discharge electrode and an electrode are disposed with a dielectric placed therebetween, a voltage which does not generate discharge only by application thereof but generating discharge by heating is applied between the discharge electrodes and the electrode, and generation of ions generated by discharge of said discharge electrodes is controlled by heating of said heating element disposed according to said respective discharge electrodes, the ion generator can control generation of ions generated by discharge of the discharge electrodes by heating of the heating element at a low voltage. Therefore, it is possible to provide an image forming apparatus which is inexpensive and sized as small as possible and constructed so as to selectively irradiate a recording medium rewritable by electrical fields with ions to form an electrostatic latent image on the surface of the recording medium by using an ion generator, and selectively displays the image.

Furthermore, since an ion generator is constructed so that a discharge electrode and an electrode are disposed with a dielectric placed therebetween, a voltage which does not generate discharge only by application thereof but generates discharge by heating is applied between the discharge electrodes and the electrode, and generation of ions generated by discharge of the discharge electrodes is controlled by heating the heating element disposed according to the respective discharge electrodes, the ion generator can control generation of ions by discharge of the discharge electrodes by heating the heating element at a low voltage. Therefore, it is possible to provide an image forming apparatus which is inexpensive and sized as small as possible and constructed so as to selectively irradiates an image carrier consisting of a dielectric with ions to form an electrostatic latent image on the surface of the image carrier by using the ion generator, and visualizes the electrostatic latent image by toner or ink, forms a visible image of toner or ink on the image carrier surface, transfers and forms the visible image onto a recording sheet.

DESCRIPTION OF THE PREFERRED EMBODIMENT

Figure 1:
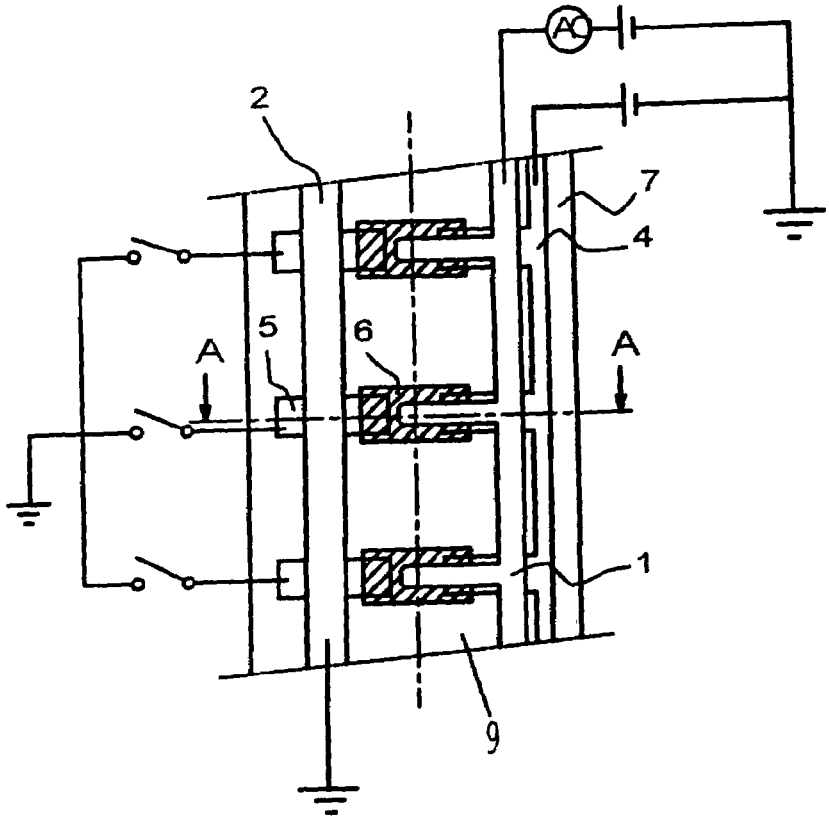
FIG. 1 is a block diagram of an ion generator of an embodiment of the invention.
Figure 2:
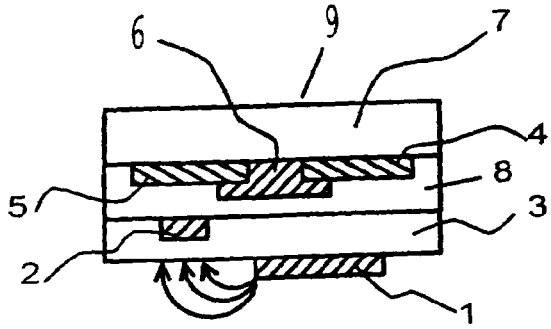
FIG. 2 is a sectional view of the ion generator of the embodiment of the invention.

Hereinafter, a first embodiment of the invention is described with reference to FIG. 1 and FIG. 2. FIG. 1 is a block diagram of an ion generator 9 of the invention, and FIG. 2 is a sectional view thereof.

On both surfaces of the dielectric 3 made of glass, ceramic, ormica, etc., a discharge electrode 1 and an electrode 2 are provided. On the discharge electrode 1, a DC bias is superposed on a high voltage AC. The electrode 2 is grounded. A heating element 6 is provided for each discharge electrode 1 via an insulator 8. The heating element 6 is in contact with a common electrode 4 and an individual electrode 5, and to the common electrode 4, a low voltage to be applied to the heating element, for example, 24 V DC is applied. The individual electrode 5 is switched according to data to control the heating element. By control of the heating element, the discharge electrode 1 is also temperature controlled according to the data. The ion generator 9 including these members is supported by a supporter 7.

Figures 3, 4:
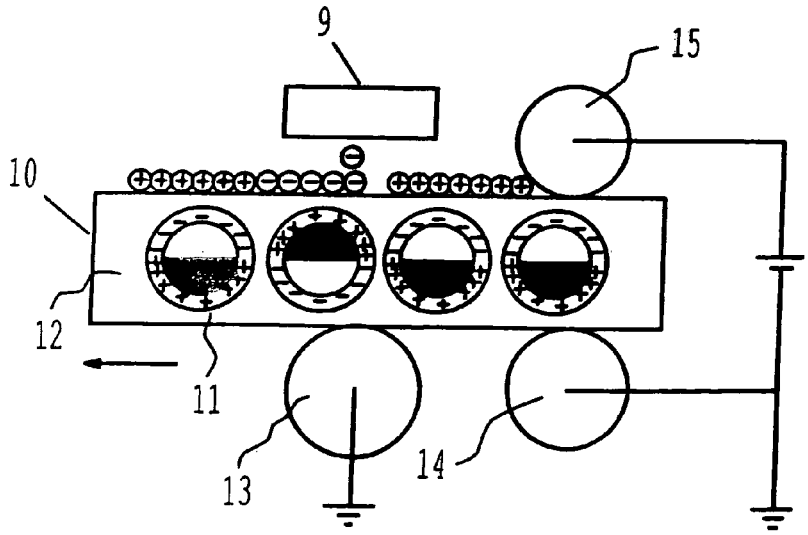
FIG. 3 is a table showing a difference in the discharge start voltage depending on whether or not heating is applied.
FIG. 4 is a block diagram of an image forming apparatus of a second embodiment of the invention.

FIG. 3 shows a discharge state, confirmed in the dark, of a trial head including a dielectric 3 that is formed of a mica plate with a thickness of 100 microns having an discharge electrode 1 and an electrode 2 formed on both surfaces by double-side etching and bonded to a thermal head that is used for a conventional thermal facsimile so that the discharge electrode 1 corresponds to the heating element 6, when the AC applying conditions are changed.

As seen in FIG. 3, the discharge start voltage differs between the case where the heating element is heated and the case where the heating element 6 is not heated. This point is the most important in the invention. The inventor found that the discharge start voltage changed according to the temperature of the discharge electrode 1 through detailed experiments, and focused on this point.

Namely, in the conditions of FIG. 3, discharge control is possible for each discharge electrode 1 by control of the heating element 6 by setting the applying voltage to a voltage value of approximately 2.0 kVp-p through 2.5 kVp-p. Namely, a normal thermal head controls by 5 V for 24 V DC, so that discharge is controlled by 5 V.

In conventional ion generators, since separate high voltages are applied to the respective discharge electrodes to perform control, the high voltages must be switched separately, so that a control IC with an extremely high withstand voltage is necessary, and this bottlenecks reduction in cost and size.

Namely, for controlling an ion generator with a resolution of 300 DPI, in a case where a high voltage of 3 kVp-p is applied, discharge of a high voltage of 3 kVp-p for 300 DPI must be controlled, and it is obvious that this requires high costs.

Ions discharged in response to control of the heating element 6 are applied with an AC voltage, so that negative ions and positive ions are generated. Therefore, depending on the polarity of the DC bias voltage superposed on the discharge electrode 1, only negative ions or positive ions can be extracted. A charging object is charged by the extracted ions.

Furthermore, the invention has another great advantage in that, as a manufacturing method, as in the case of a conventional thermal head, after the common electrode 4 and the individual electrode 5 for a heating element 6 are formed by etching or sputtering, etc., the heating elements 6 are formed by printing, etc., and the insulator 8 is coated, and then the electrode 2, the dielectric 3, and the discharge electrode 1 are formed by the same method. Namely, manufacturing can be performed by using the existing thermal head manufacturing facilities. It is obvious that the same effect is also obtained by a thermal head heating method that is not mentioned in this specification.

According to a second embodiment of the invention, an image forming apparatus is obtained which is inexpensive and sized as small as possible and constructed so as to selectively irradiate a recording medium rewritable by electrical fields with ions to form an electrostatic latent image on the surface of the recording medium by using an ion generator wherein discharge electrodes and an electrode are disposed via dielectrics disposed between these, heating elements are provided corresponding to the discharge electrodes, the temperatures of the discharge electrodes are controlled, and an appropriate high voltage is applied between the discharge electrodes and the electrode, the discharge of the discharge electrodes is controlled by heating of the heating elements, and generation of ions to be generated by discharge of the discharge electrodes can be controlled by a low voltage by means of heating control of the heating elements, and selectively displays the image.

Description is given on the basis of FIG. 4. FIG. 4 is a simple block diagram of the image forming apparatus of the second embodiment of the invention.

The reference numeral 9 denotes an ion generator of the invention, and 10 denotes a rewritable recording medium. The recording medium 10 denotes a rewritable recording medium, and 13 denotes a grounding electrode roller disposed opposite to the ion generator 9 with the recording medium placed therebetween. The recording medium 10 is such that it includes white-black micro spheres 11 in an elastomer 12 made of a silicon rubber, etc., and by impregnating the interface between the elastomer 12 and the white-black micro spheres 11 with silicon oil, etc., the white-black micro spheres 11 are made rotatable. It is well known that on the interface between the white-black micro spheres 11 and silicon oil, that is, between the white and black surfaces, the charged amount or charged polarity differs. Namely, when an electrical field is applied to both sides of the white-black micro spheres 11 with different charged amounts or charged polarities, depending on the direction of the electrical field, the white-black micro spheres 11 rotate. By controlling the directions of the white-black micro spheres 11, an image is formed. The recording medium 10 is formed into a sheet, and conveyed in the direction of the arrow. The recording medium 10 is conveyed between an opposite roller 14 and a refresh roller 15 first, and then the directions of the white-black micro spheres 11 are uniformly matched with each other by a bias applied between the opposite roller 14 and the refresh roller 15 so that the white surfaces are turned upward when the micro spheres are viewed from above. Thereafter, negative ions are generated according to data by the ion generator 9, and the surface of the recording medium 10 is charged to the reverse polarity. Then, the internal white-black micro spheres 11 rotate and the black surfaces move upward, whereby an image is formed. The rotated white-black micro spheres 11 can maintain the image even after the bias is eliminated. Thus, according to the invention, an image forming apparatus is provided which is inexpensive, sized as small as possible, and rewritable.

Figure 5:
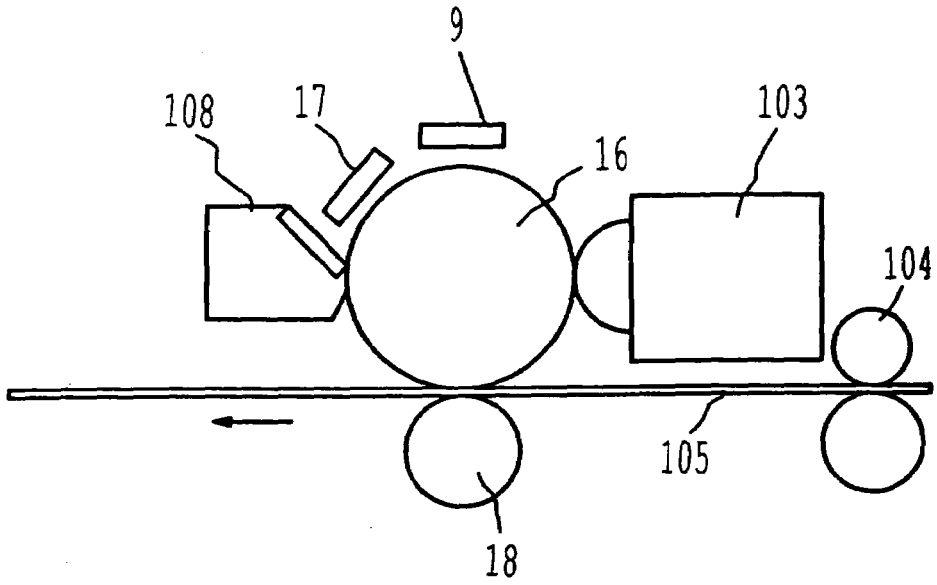
FIG. 5 is a block diagram of an image forming apparatus of a third embodiment of the invention.
Figure 6:
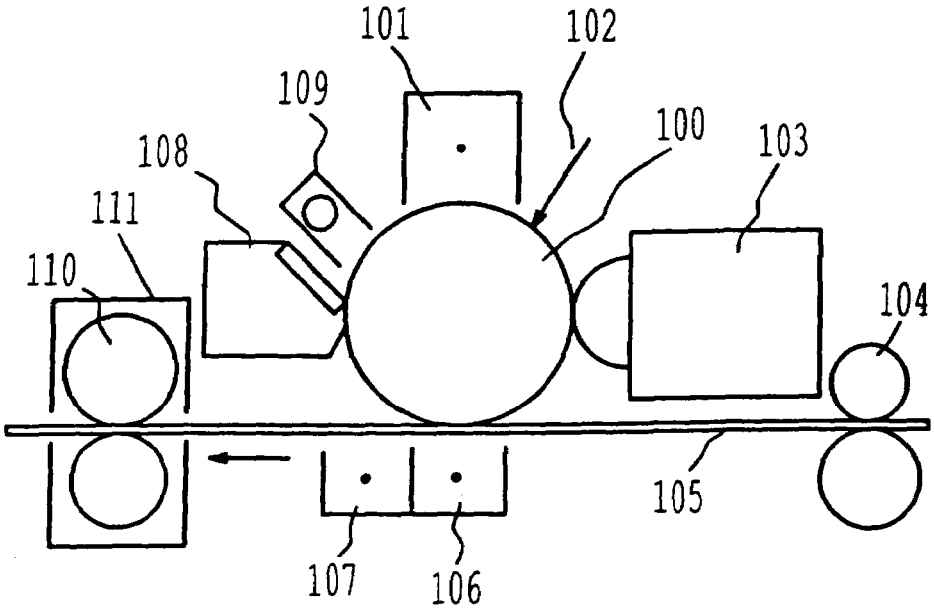
FIG. 6 is a block diagram of a conventional electrophotographic recording device.

An image forming apparatus of a third embodiment of the invention is described with reference to FIG. 5. In FIG. 5, description of the same members as in the conventional example is omitted. The reference numeral 16 denotes an image carrier which uses an aluminum element tube coated with a resinous dielectric, etc., or an aluminum element tube the surface of which is anodized. The reference numeral 17 denotes an electricity remover which removes electricity by corona discharge. The reference numeral 18 denotes a transfer fixing roller which uses an aluminum roller, etc., coated by silicon rubber. First, the surface of the image carrier 16 is removed of electricity by the electricity remover 17, and then negative ions are generated according to data by the ion generator 9. The generated negative ions charge the surface of the image carrier 16 according to data to form an electrostatic latent image. Next, the electrostatic latent image on the image carrier is developed by the developing device 103, and toner or ink adheres to the surface. The adhering toner or ink is transferred and fixed to the recording sheet 105 by a pressure of the transfer fixing roller 18. In this case, by using an anodized aluminum element tube as the image carrier 16, using a hard metal roller as the transfer fixing roller 18, and using pressure fixing toner as the toner, transferring and fixing are performed simultaneously. The invention is characterized in that simultaneous transferring and fixing are possible. The conventional electrophotographic recording device requires use of a photoconductor that is an optical semiconductor and very weak against pressure and heat, so that simultaneous transferring and fixing as in the invention are not possible, and fixing must be separately performed by using a fixing device. In the invention, the fixing device can be omitted, so that an image forming apparatus is provided which is inexpensive and sized as small as possible.

What is claimed is:

1. An ion generator for selectively generating ions comprising discharge electrodes and heating elements disposed according to the respective discharge electrodes, wherein voltage is applied, which does not generate discharge only by being applied to said discharge electrodes but generates discharge by heating said discharge electrodes, and generation of ions generated by discharge of said discharge electrodes is controlled by heating said heating element.

2. An ion generator for selectively generating ions, wherein a discharge electrode and an electrode are disposed with a dielectric placed therebetween, a voltage which does not generate discharge only by application thereof but generating discharge by heating is applied between said discharge electrodes and said electrode, and generation of ions generated by discharge of said discharge electrodes is controlled by heating of said heating element disposed according to said respective discharge electrodes.

3. An image forming apparatus which selectively irradiates a recording medium rewritable by electrical fields with ions by using the ion generator according to claim 1 or 2 to form an electrostatic latent image on a surface of the recording medium, and selectively displays the image.

4. An image forming apparatus which selectively irradiates an image carrier consisting of a dielectric with ions by using the ion generator according to claim 1 or 2 to form an electrostatic latent image on a surface of said image carrier, visualizes said electrostatic latent image by toner or ink, forms a visible image of toner or ink on the surface of said image carrier, and transfers and forms the visible image onto a recording sheet.

5. A method for controlling ion generation, which controls ion generation by controlling the temperature of discharge electrodes, wherein presence or absence of discharge is controlled by varying the discharge starting voltage by heating of respective discharge electrodes to which voltage that does not generate discharge only by application thereof but generates discharge by heating is applied.

* * * * *